US007052255B2

(12) United States Patent
Hong et al.

(10) Patent No.: US 7,052,255 B2
(45) Date of Patent: May 30, 2006

(54) APPARATUS FOR CHANGING CAPACITY OF SCROLL COMPRESSOR WITH MOVABLE SEAL MEMBER

(75) Inventors: Sog Kie Hong, Seoul (KR); Hong Hee Park, Changwon (KR)

(73) Assignee: LG Electronics Inc., Seoul (KR)

( * ) Notice: Subject to any disclaimer, the term of this patent is extended or adjusted under 35 U.S.C. 154(b) by 122 days.

(21) Appl. No.: 10/338,749

(22) Filed: Jan. 9, 2003

(65) Prior Publication Data

US 2004/0042911 A1 Mar. 4, 2004

(30) Foreign Application Priority Data

Aug. 28, 2002 (KR) ..... 10-2002-0051236

(51) Int. Cl.
*F01C 1/00* (2006.01)

(52) U.S. Cl. ..... 418/55.4; 417/310; 417/410.5; 418/55.6; 418/55.1

(58) Field of Classification Search ..... 418/55.4, 418/55.6, 55.1; 417/310, 410.5
See application file for complete search history.

(56) References Cited

U.S. PATENT DOCUMENTS 5,076,771 A * 12/1991 Ban et al. ..... 418/55.4
5,520,526 A * 5/1996 Fujio ..... 418/55.4
5,897,299 A * 4/1999 Fukunaga ..... 417/316
6,074,185 A * 6/2000 Protos ..... 418/55.4
6,457,948 B1 * 10/2002 Pham ..... 417/292
2002/0098102 A1 * 7/2002 Gennami et al. ..... 418/55.4

FOREIGN PATENT DOCUMENTS

CN 1154156 A 7/1997
JP 03074590 A * 3/1991
JP 05296169 A * 11/1993
JP 06101663 A * 4/1994

* cited by examiner

*Primary Examiner*—Timothy S. Thorpe
*Assistant Examiner*—Emmanuel Sayoc
(74) *Attorney, Agent, or Firm*—Birch, Stewart, Kolasch & Birch, LLP

(57) ABSTRACT

An apparatus for changing capacity of scroll compressor comprises: a seal member movably installed on one of facing surfaces of a fixed scroll so as to seal a compression space made by the fixed scroll and orbiting scroll; a back pressure passage formed to be communicated from a point, where the seal member is contacted, to an outer circumferential surface of fixed scroll; an exhaust pipe installed on outer circumferential surface of the fixed scroll to be communicated with back pressure passage; and an exhaust pipe opening/closing valve installed on center part of exhaust pipe to open/close the exhaust pipe selectively, and thereby, sealability can be improved and low capacity can be outputted without decelerating orbiting scroll in low capacity operation.

19 Claims, 11 Drawing Sheets

APPARATUS FOR CHANGING CAPACITY OF SCROLL COMPRESSOR WITH MOVABLE SEAL MEMBER

BACKGROUND OF THE INVENTION

1. Field of the Invention

The present invention relates to an apparatus for changing capacity of a scroll compressor, and particularly, to an apparatus for changing capacity of a scroll compressor which is able to control an output capacity of the scroll compressor.

2. Description of the Background Art

Generally, a compressor is a device for changing mechanical energy into latent energy of fluid, and can be divided into reciprocating type, scroll type, centrifugal type and vane type.

Among those types, a scroll type compressor has a structure in which gas is sucked, compressed and discharged using a rotating body as in the centrifugal or vane type, unlike the reciprocating type using linear reciprocating movements of an opening/closing member.

FIG. 1 is a longitudinal cross-sectional view showing inner part of a conventional scroll compressor, FIG. 2 is a longitudinal cross-sectional view showing a seal member in FIG. 1, and FIG. 3 is a transverse cross-sectional view showing the seal member in FIG. 1.

As shown therein, the conventional scroll compressor comprises: a case 1 having a gas suction pipe (SP) and a gas discharge pipe (DP); a main frame 2 and a sub-frame (not shown) installed on upper and lower parts of an inner circumferential surface of the case 1; a driving motor 3 installed between the main frame 2 and the sub-frame; a rotary shaft 4 coupled on center part of the driving motor 3 so as to transmit rotating force of the driving motor 3; an orbiting scroll 5 having a wrap 5*a* of involute curve shape on upper part thereof, and installed on upper part of the rotary shaft 4 to be rotate eccentrically; and a fixed scroll 6 fixed on upper part of the main frame 2 and coupled to the orbiting scroll 5, and having a wrap 6*a* of involute curve shape therein to form a plurality of compression spaces P.

The inner part of the case 1 is partitioned into a suction pressure region (S1) and a discharging pressure region (S2) by a housing 7, and a middle pressure region (S3) is formed on a position communicating with the compression space P.

A gas suction hole 6*b* and a discharge hole 6*c* are formed on a side surface and on a center part of the fixed scroll 6, and a non-return valve 8 is installed on an upper surface of the fixed scroll 6 to prevent the discharged gas from flowing backward.

A tip seal recess 10 is formed on an end of the wrap 6*a* of the fixed scroll 6 so as to prevent the gas in the compression space (P) from leaking, and a seal member 11 is movably installed on the tip seal recess 10 (an end of the wrap of the orbiting scroll is same as that of the fixed scroll).

In addition, a clearance (C) for inducing gas is formed between an end surface of the seal member 11 and the end surface of the wrap 6*a*, and the gas of the compression space (P) is induced through the clearance (C), and the induced gas is induced into the tip seal recess 10.

Also, a controller which is able to change a capacity by controlling rotating number of the orbiting scroll is installed on one side of the orbiting scroll.

Hereinafter, in the conventional scroll compressor constructed as above, when electric power is applied to the driving motor 3, the driving motor 3 rotates the rotary shaft 4, and at that time, the orbiting scroll 5 coupled to the rotary shaft 4 is rotated as much as an eccentric distance.

At that time, the plurality of compression spaces (P) formed between the wrap 5*a* of the orbiting scroll 5 and the wrap 6*a* of the fixed scroll 6 are moved toward the center part of the orbiting scroll 6 gradually by the orbiting movements of the orbiting scroll 5, and thereby reducing the volume thereof.

The gas in the suction pressure region (S1) is sucked into the compression space (P) through the suction hole 6*b* continuously due to the volume reducing in the compression space (P), and the sucked gas is discharged into the discharging pressure region (S2) through the discharge hole 6*c*.

At that time, in case that the compressor is normally operated, the gas in the compression space is induced into the tip seal recess 10 through the clearance C for inducing gas, and the induced gas compresses the seal member 11. The end surface of the compressed seal member 11 is adhered to the upper surface of the orbiting scroll 5 to prevent the gas leakage of the compression space.

Also, during low capacity operation, the rotating times of the orbiting scroll is controlled by the controller, and the suction gas is compressed and discharged in the same way described above.

However, in the conventional scroll compressor, since rotating speed of the orbiting scroll is reduced in order to change the capacity, the seal member is adhered tightly to the upper surface of the orbiting scroll due to the low pressure of the compression gas, and thereby, the compression gas may be leaked.

Also, according to the conventional art, an additional controller of high price should be disposed in order to control the deceleration of the orbiting scroll, and therefore, the fabrication cost is increased.

SUMMARY OF THE INVENTION

Therefore, an object of the present invention is to provide an apparatus for changing capacity for a scroll compressor which is able to improve compression efficiency by increasing sealability of a compression space in normal operation, and to output low capacity without decelerating an orbiting scroll in low capacity operation.

To achieve the object of the present invention, as embodied and broadly described herein, there is provided an apparatus for changing capacity for a scroll compressor comprising: a seal member installed on a fixed scroll to be movable, so as to seal a compression space made by the fixed scroll and the orbiting scroll; and a means for controlling seal member position which is able to control a position of the seal member according to operation status of the compressor.

A tip seal recess is formed on an end portion of a wrap of the orbiting scroll, and the seal member is installed on the tip seal recess to be movable in up-and-down direction.

The means for controlling seal member position comprises: a back pressure passage formed to be communicated from a position where the seal member is contacted to an outer circumferential surface of the fixed scroll; and a changing valve installed between a gas discharge pipe and a gas suction pipe so as to selectively supply high pressure gas on discharge side and low pressure gas on suction side.

Also, the apparatus for changing capacity for a scroll compressor comprises: a seal member of metal installed on a fixed scroll to be movable so as to selective seal a compression space made by the fixed scroll and an orbiting scroll; a coil iron core installed in the fixed in the fixed scroll; and a power unit connected to the coil iron core so as to move the seal member by magnetizing selectively the coil iron core.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 10 is a longitudinal cross-sectional view showing a capacity changing operation when the compressor is operated normally, and FIG. 11 is a longitudinal cross-sectional view showing a capacity changing operation when the compressor is in low capacity status.

DETAILED DESCRIPTION OF THE PREFERRED EMBODIMENTS

Reference will now be made in detail to the preferred embodiments of the present invention, examples of which are illustrated in the accompanying drawings.

Figure 4:
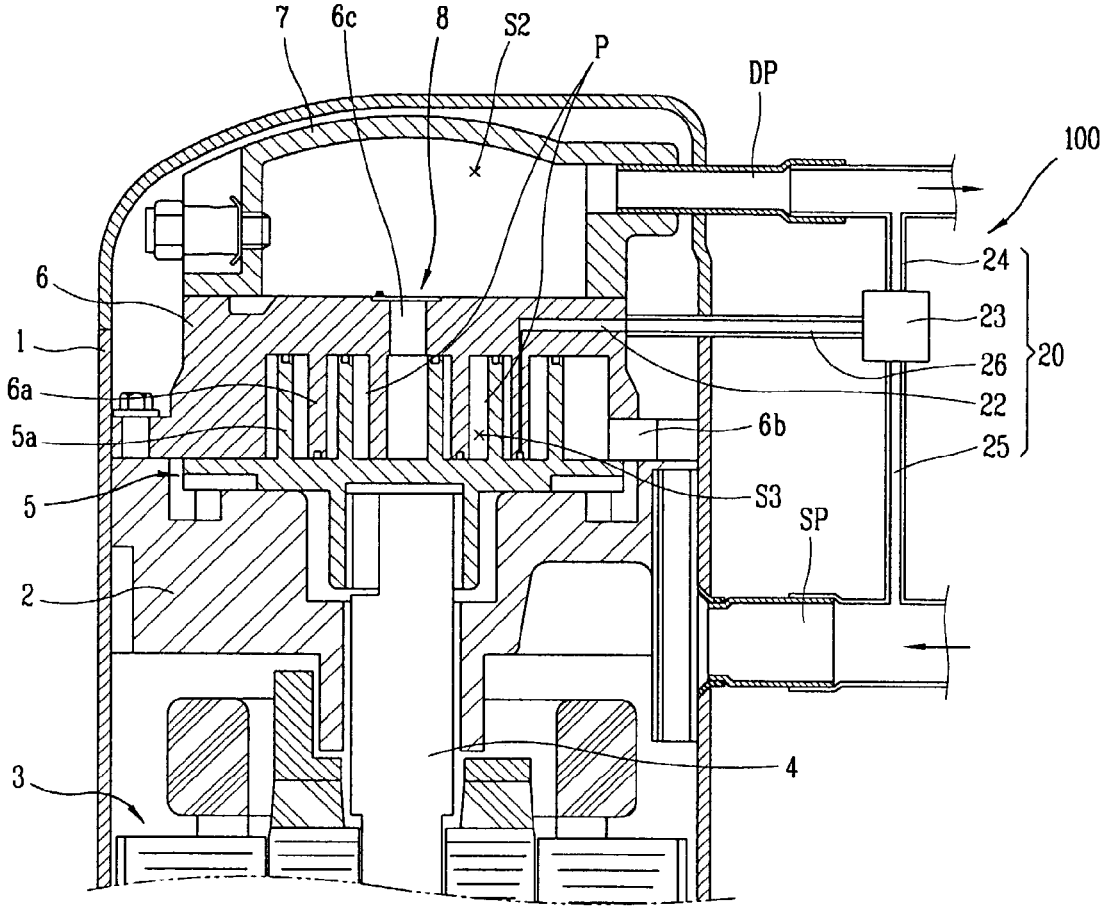
FIG. 4 is a longitudinal cross-sectional view showing an apparatus for controlling capacity for a scroll compressor according to an embodiment of the present invention.
Figure 5:
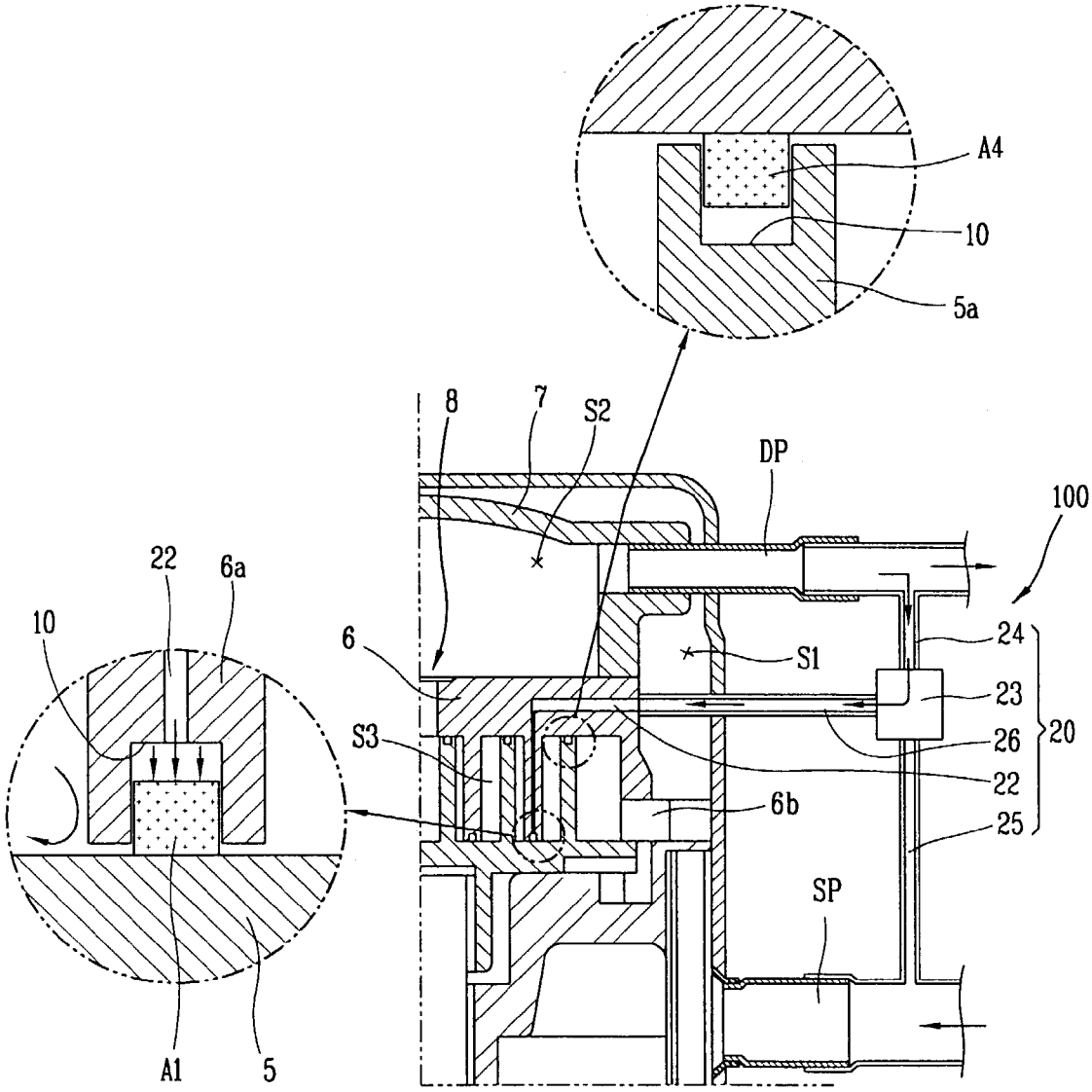
FIG. 5 is a longitudinal cross-sectional view showing a capacity changing operation when the compressor in FIG. 4 is operated normally.
Figure 6:
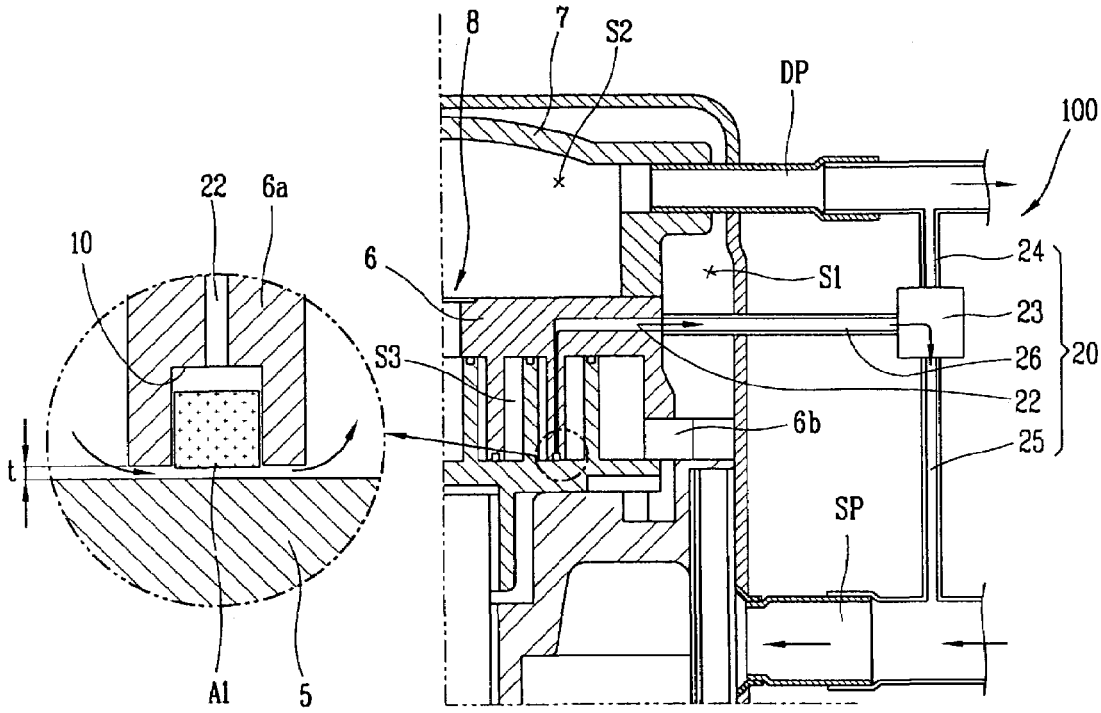
FIG. 6 is a longitudinal cross-sectional view showing a capacity changing operation when the compressor shown in FIG. 4 is in low capacity status.

FIG. 4 is a longitudinal cross-sectional view showing an apparatus for changing capacity for a scroll compressor according to an embodiment of the present invention, FIG. 5 is a longitudinal cross-sectional view showing a capacity changing operation when the compressor shown in FIG. 4 is operated normally, and FIG. 6 is a longitudinal cross-sectional view showing a capacity changing operation when the compressor shown in FIG. 4 is in low pressure status.

As shown therein, the scroll compressor according to the present invention comprises: a case 1 divided into a suction pressure region (S1) sucking gas and a discharging pressure region (S2) discharging the gas; a fixed scroll 6 fixedly installed in the case 1; an orbiting scroll 5 coupled to the fixed scroll 6 to form a compression space (P) communicated with a middle pressure region (S3) therein, and coupled to a rotary shaft 4 of a driving motor 3 in the case 1 to be able to orbit eccentrically so as to suck, compress and discharge the gas; and a capacity changing apparatus 100 sealing appropriately the compression space (P) according to operational status of the compressor.

Also, the apparatus for changing capacity 100 of the scroll compressor according to the embodiment of the present invention comprises: a seal member (A1,A4) movably installed on one surface between two facing surfaces of the fixed scroll 6 and the orbiting scroll 5 so as to seal the compression space (P) made by the fixed scroll 6 and the orbiting scroll 5; and a means for controlling position of seal member 20 and 30 which is able to control the position of the seal member (A1) according to the operating status of the compressor.

In more detail, a tip seal recess 10 is formed on ends of wraps of the fixed scroll 6 and of the orbiting scroll 5, and the seal member (A1,A4) of the wrap (6*a*,5*a*) is installed on the tip seal recess 10 so as to move in up-and-down direction.

The seal member (A1,A4) may be installed on one of end surfaces on the wrap 6*a* of the fixed scroll 6 and on the wrap 5*a* of the orbiting scroll 5, however, it is desirable that the seal member(A1,A4) is installed on both end surfaces and formed as a single body so as to increase the sealability of the compression space.

Also, it is desirable that the seal member (A1,A4) is constructed integrally so as to improve the sealability of the compression space.

In the present invention, a means for controlling position of the seal member 20 which is able to increase or reduce the sealability of the compression space (P) by controlling the position of the seal member (A1) according to the operational status of the compressor, that is, according to the normal operation or low capacity operation of the compressor is disposed.

In the apparatus for controlling capacity according to the embodiment of the present invention, a back pressure passage 22 is formed to be communicated from the tip seal recess 10 to an outer circumferential surface of the fixed scroll 6 as the means for controlling position of seal member, and a changing valve 23 is installed between the gas discharge pipe DP and the gas suction pipe SP so as to selectively support discharging high pressure gas or suction low pressure gas into the back pressure passage 22.

Also, a discharge bypass pipe 24 is installed between the changing valve 23 and the discharge pipe (DP), a suction bypass pipe 25 is installed between the changing valve 23 and the suction pipe (SP), and a back pressure pipe 26 is installed between the changing valve 23 and the back pressure passage 22.

The changing valve 23 is located on a position where the discharge by pass pipe 24, the back pressure pipe 26, the back pressure passage 22 and the suction bypass pipe 25 cross each other so that some of the gas in the discharge pipe is supplied to the discharge bypass pipe 24, the back pressure pipe 26 and the back pressure passage 22 in normal operation, and so that some of the suction pipe is supplied to the suction bypass pipe 25, the back pressure pipe 26 and to the back pressure passage 22 in low capacity operation.

The changing valve 23 is a 3-way divertor valve. In addition, the changing valve may be operated manually, however, it is desirable that the changing valve 23 is operated automatically by a sensor or by a controller according to the operational status of the compressor.

Figure 1:
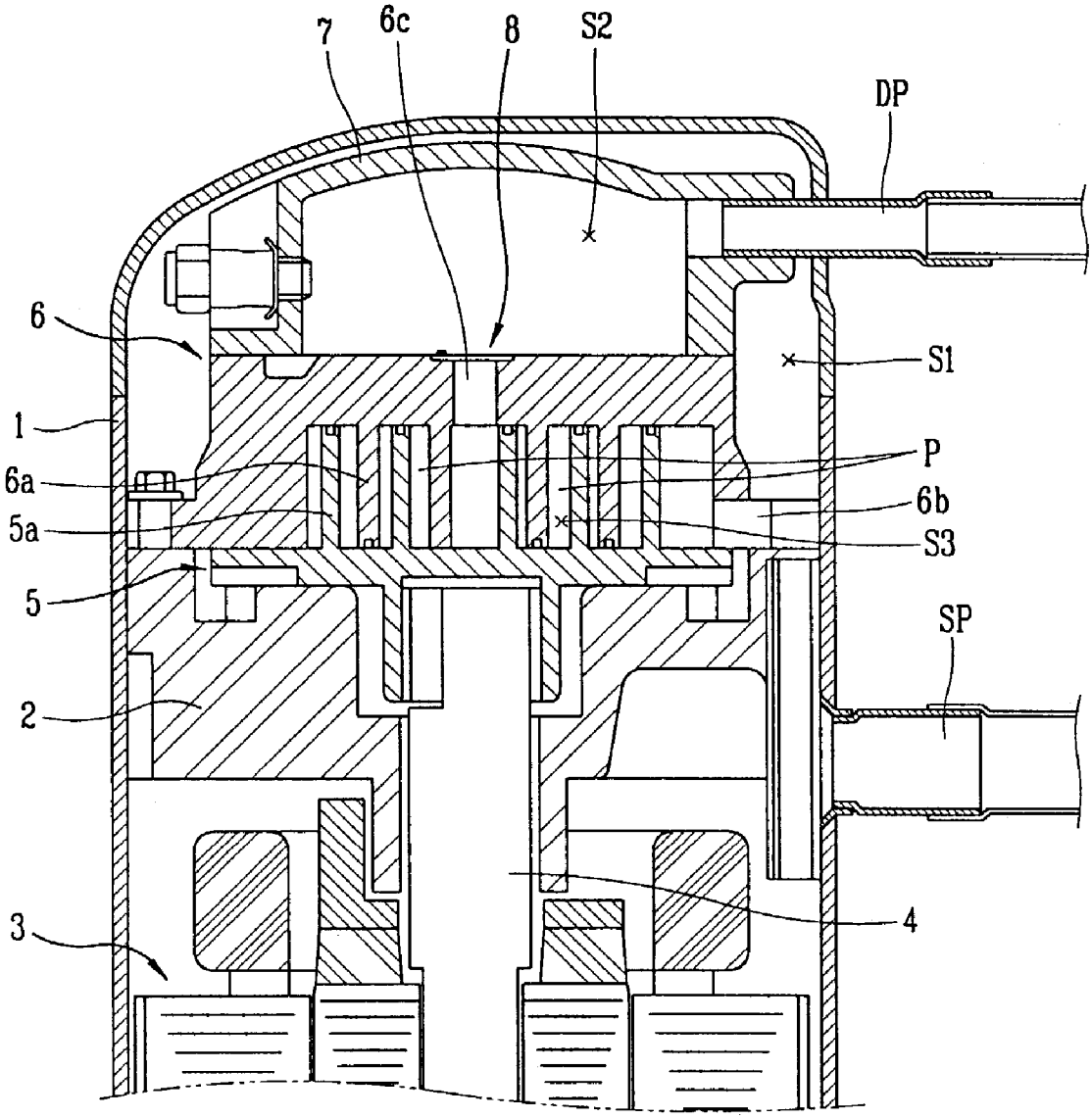
FIG. 1 CONVENTIONAL ART
FIG. 1. is a longitudinal cross-sectional view showing a part of a conventional scroll compressor.
Figure 2:
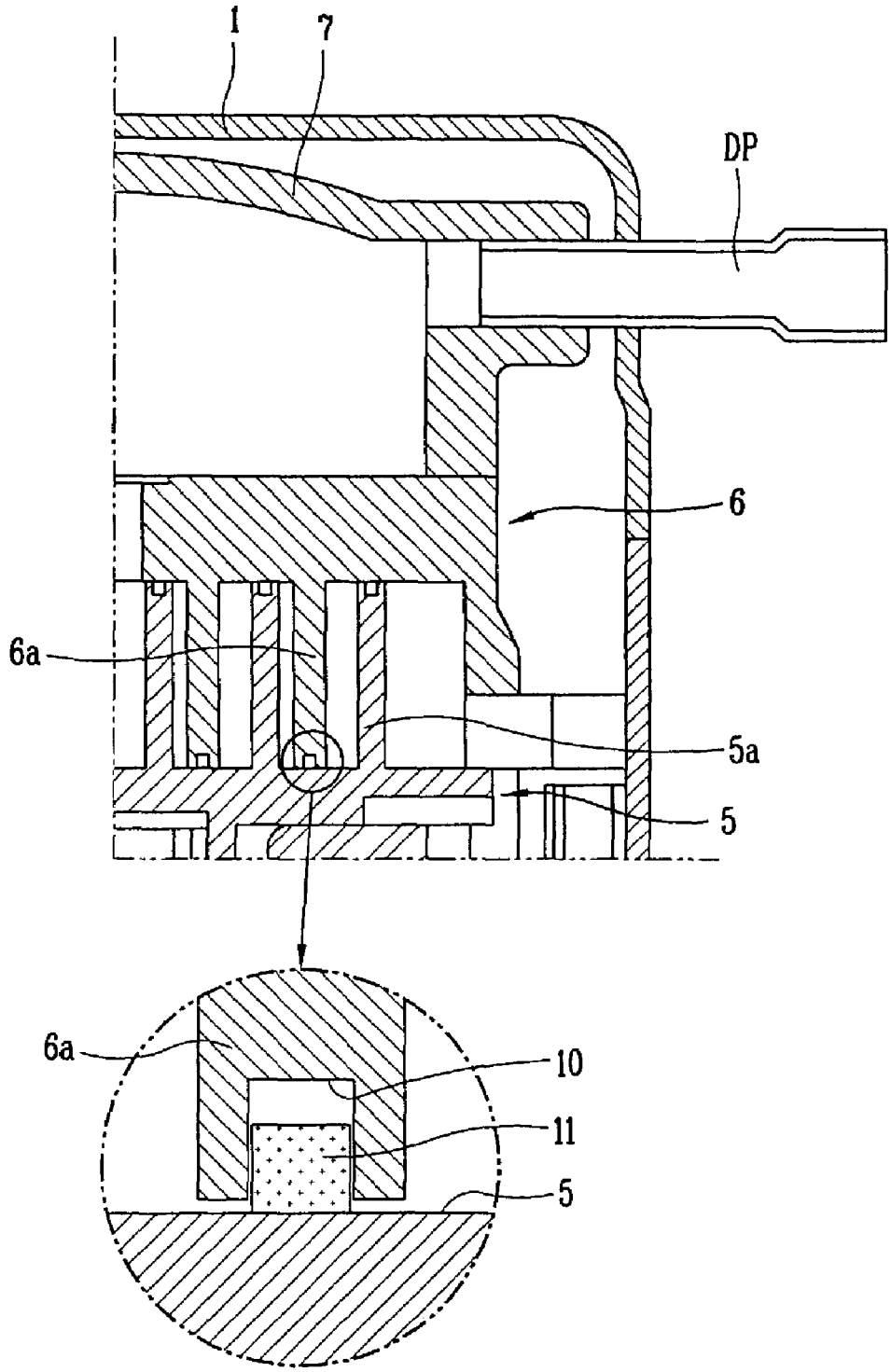
FIG. 2 CONVENTIONAL ART
FIG. 2 is a longitudinal cross-sectional view showing a seal member in FIG. 1.
Figure 3:
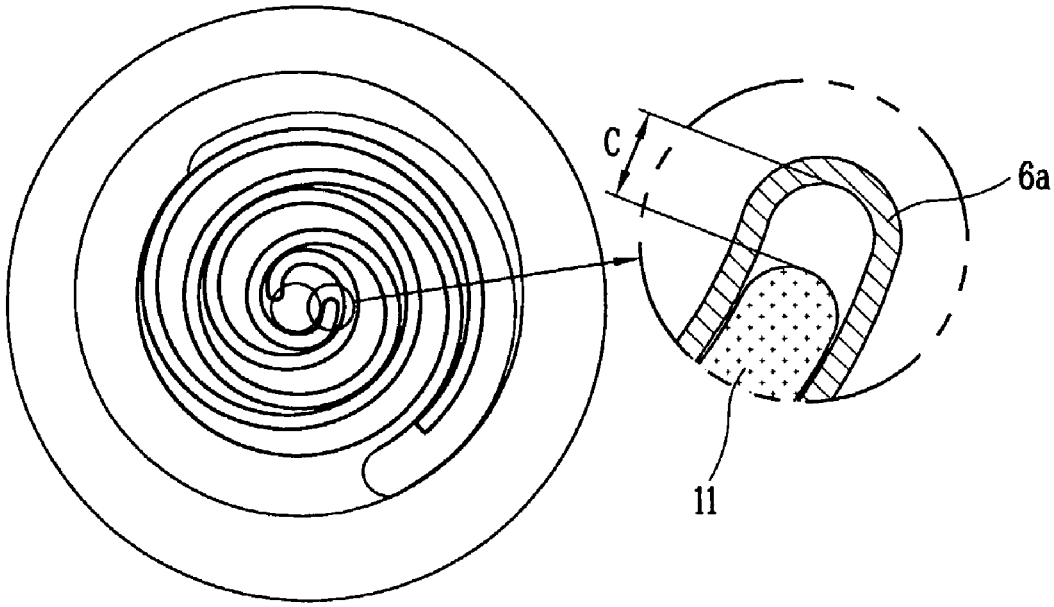
FIG. 3 CONVENTIONAL ART
FIG. 3 is a transverse cross-sectional view showing the seal member in FIG. 1.

Herein, as shown in FIG. 3, a clearance (C) for inducing the gas may be formed between the end of the seal member (A1) and the end of the wrap 6*a*, however, In the present invention, it is desirable that the clearance (C) is not formed in order to operate the seal member smoothly.

Hereinafter, operations and effects of the apparatus for changing capacity for the scroll compressor according to the embodiment of the present invention will be described as follows.

The operations of the compressor will be described in brief referring to FIG. 4. The orbiting scroll 5 sucks the gas in the suction pressure region (S1), compresses in the compression space (P) and discharges the gas into the discharging pressure region (S2) while orbiting continuously by the driving motor 3.

According to the present invention, the sealability of the compression space is able to be improved in normal operation, and the low capacity output can be obtained without the controller and without decelerating the orbiting scroll in low capacity operation.

As shown in FIG. 5, when the compressor is operated normally, the discharge bypass 24 and the back pressure pipe 26 are communicated to each other by the changing valve 23, and thereby some of the discharge gas flowing in the discharge pipe (DP) is induced into the tip seal recess 10 through the discharge bypass pipe 24, the back pressure pipe 26 and the back pressure passage 22.

The seal member (A1) is compressed by the discharge gas induced into the tip seal recess 10 and attached on upper surface of the orbiting scroll 5. And at that time, the gas in the compression space (P) is not leaked to outer side and the compression efficiency of the compressor can be increased.

On the other hand, as shown in FIG. 6, when the compressor is wanted to be operated in low capacity, the suction bypass 25 and the back pressure pipe 26 are communicated with each other by the changing valve 23, and the gas in the tip seal is circulated to the back pressure passage 22, the back pressure pipe 26 and the suction bypass 25, and then, the gas is sucked into the suction pipe SP again by the flux of the suction gas.

The pressure of the compression space P is higher than that on the back pressure passage 22, and thereby, the seal member (A1) is risen by the pressure of the compression space P. At that time, a gap (t) is generated.

At that time, some of the gas in the compression space P is leaked through the gap (t) generated between the seal member (A1) and the orbiting scroll 5.

Therefore, the compression gas in the compression space P is controlled to be desired pressure, and the low capacity is outputted through the discharge pipe DP.

In the present invention, the low capacity output can be obtained without decelerating the orbiting scroll 5, and thereby, an additional controller (not shown) for controlling the deceleration of the orbiting scroll 5 is not required.

Hereinafter, an apparatus for controlling capacity according to another embodiment of the present invention will be described as follows with reference to FIGS. 7 through 9.

Figure 7:
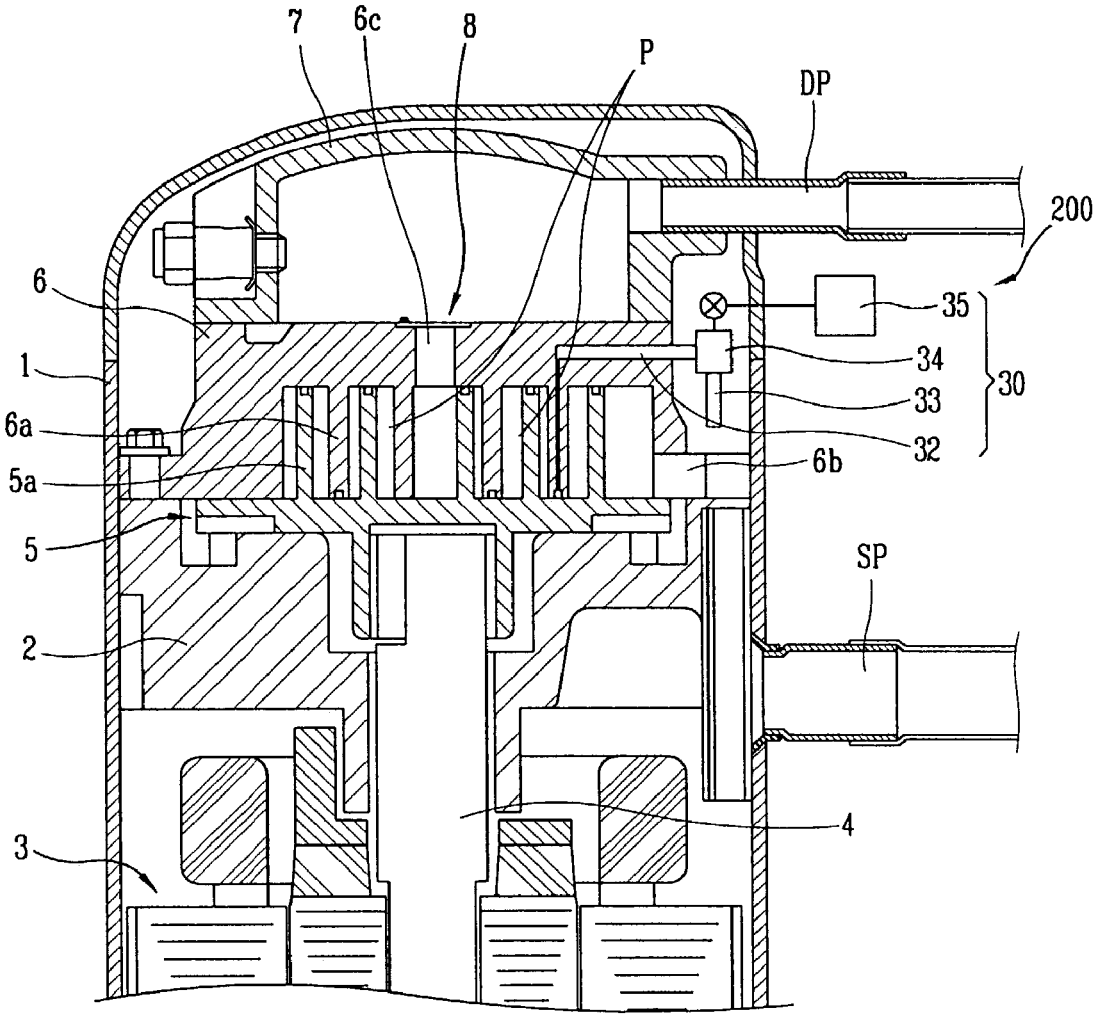
FIG. 7 is a longitudinal cross-sectional view showing an apparatus for controlling capacity for a scroll compressor according to another embodiment of the present invention.
Figure 8:
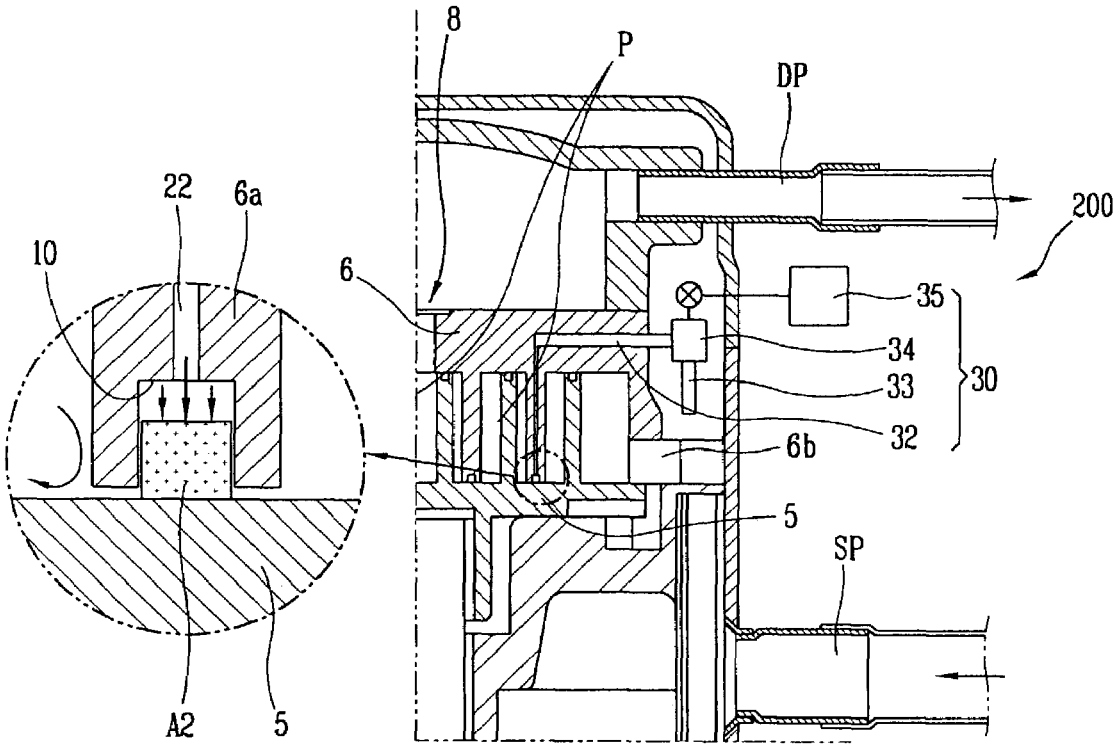
FIG. 8 is a longitudinal cross-sectional view showing a capacity changing operation when the compressor shown in FIG. 7 is operated normally.
Figure 9:
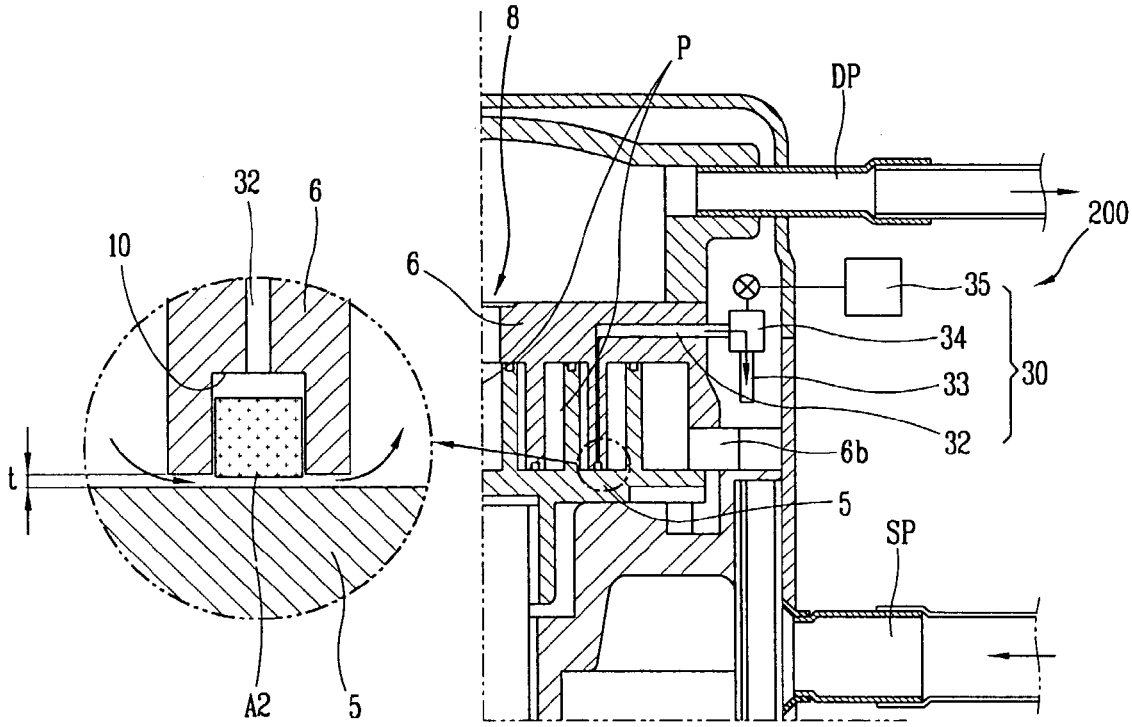
FIG. 9 is a longitudinal cross-sectional view showing a capacity changing operation when the compressor shown in FIG. 7 is in low capacity status.

FIG. 7 is a longitudinal cross-sectional view showing an apparatus for controlling capacity for a scroll compressor according to another embodiment of the present invention, FIG. 8 is a longitudinal cross-sectional view showing a capacity changing operation when the compressor shown in FIG. 7 is operated normally, and FIG. 9 is a longitudinal cross-sectional view showing a capacity changing operation when the compressor shown in FIG. 7 is in low capacity status.

As shown therein, the apparatus for controlling capacity 200 according to another embodiment of the present invention comprises a back pressure passage 32 formed from the tip seal recess 10 to the outer circumferential surface of the fixed scroll 6 as a means for controlling position of seal member 30, and an exhaust pipe 33 installed on the outer circumferential surface of the fixed scroll 6 to be communicated with the back pressure passage 32.

An exhaust pipe opening/closing valve 34 is installed on a center of the exhaust pipe 33 so as to open/close the exhaust pipe 34 selectively, and a controller 35 is installed on the exhaust pipe opening/closing valve 34.

Herein, it is desirable that a clearance for inducing gas is formed between the end of the seal member and an end of the wrap 6*a* so as to induce the compression gas in the compression space into the tip seal recess 10.

Operations and effects of the apparatus for changing capacity of the scroll compressor according to another embodiment constructed as above will be described as follows.

In normal operation, the compression gas is induced into the tip seal recess 10 through the clearance for inducing gas in a state that the exhaust pipe opening/closing valve 34 is closed, and the induced compression gas compresses the seal member (A2) to downward.

As the seal member (A2) is compressed to lower part, the seal member (A2) is attached to the upper surface of the orbiting scroll 5, and thereby, the compression efficiency of the compressor can be improved without leaking the gas in the compression space P.

In low capacity operation, the pressure in the compression space P is higher that that of the back pressure passage 21 in a state that the exhaust pipe opening/closing valve 34 is opened appropriately by the controller or manually, and the seal member (A2) is risen by the pressure of the compression space P and a gap (t) is generated.

At that time, some of the gas in the compression space P is leaked through the gap (t) generated between the seal member (A2) and the orbiting scroll 5.

Therefore, the compression gas in the compression space P is controlled to be the desired pressure, and the low capacity is outputted through the discharge pipe DP.

Hereinafter, an apparatus for changing capacity according to still another embodiment of the present invention will be described as follows.

Figure 10:
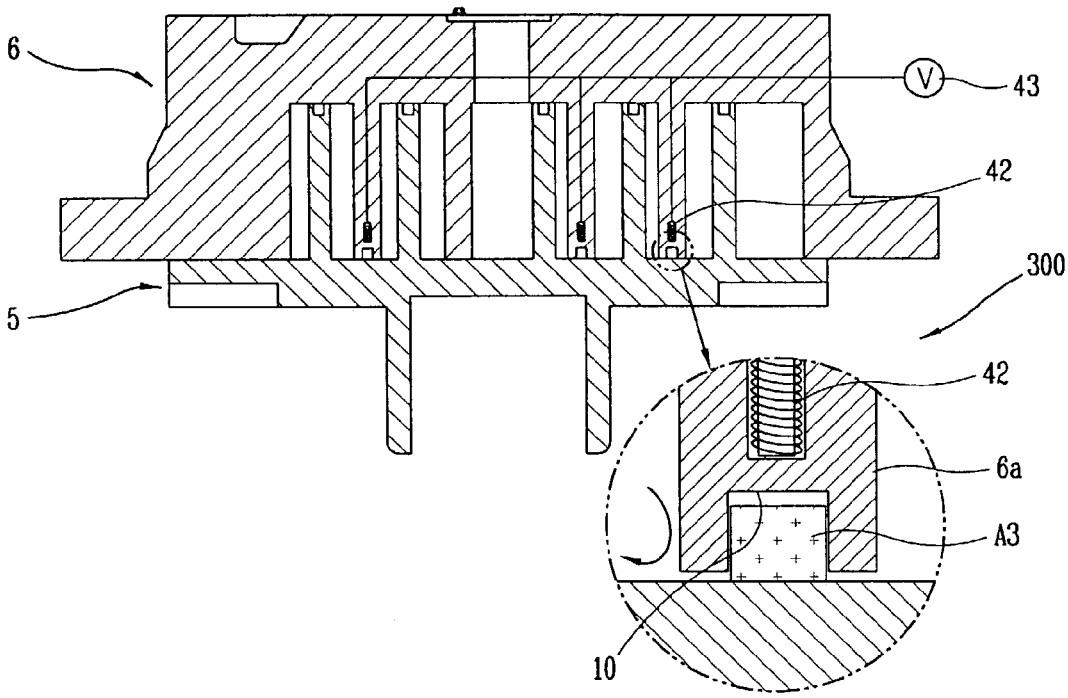
FIG. 10 and FIG. 11 are showing an apparatus for controlling capacity for a scroll compressor according to a still another embodiment of the present invention.
Figure 11:
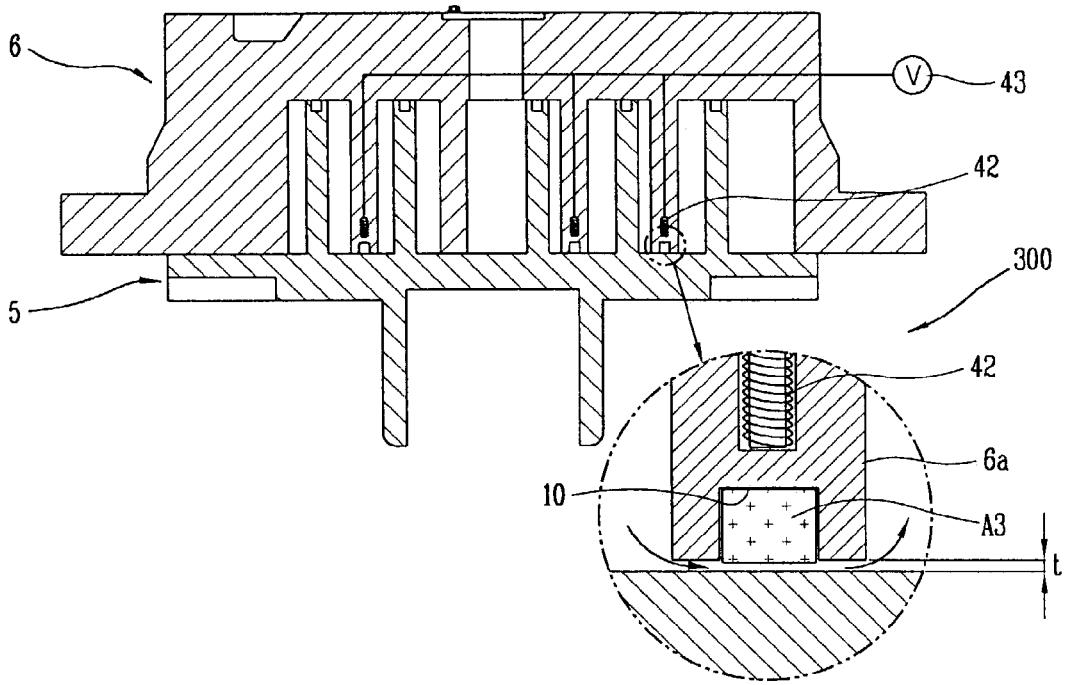

FIGS. 10 and 11 are views showing the apparatus for changing capacity in the scroll compressor according to the still another embodiment of the present invention, FIG. 10 is a longitudinal cross-sectional view showing a capacity changing operation when the compressor is normally operated, and FIG. 11 is a longitudinal cross-sectional view showing a capacity changing operation when the compressor is operated in low capacity status.

As shown therein, the capacity controlling apparatus 300 according to still another embodiment of the present invention comprises a seal member (A3) of metal material installed on one of facing surfaces of the fixed scroll 6 and the orbiting scroll 5 to be movable so as to selectively seal the compression space (P) made by the fixed scroll 6 and the orbiting scroll 5.

A coil iron core 42 is installed in the fixed scroll 6, and an electric power unit 43 connected to the coil iron core 42 is installed in order to move the seal member (A3) by magnetizing selectively the coil iron core 42.

Operations of the capacity controlling apparatus according to the still another embodiment of the present invention constructed as above will be described as follows.

In normal operation, the electric power unit 43 is turned off and the coil iron core 42 is not magnetized, and at that time, the seal member (A3) of metal material is attached to the upper surface of the orbiting scroll 5 by the weight of itself.

As the seal member (A3) is attached to the upper surface of the orbiting scroll 5, and thereby the gas in the compression space (P) is not leaked and the compression efficiency is improved.

In low capacity operation, the electric power unit 43 is turned on and the coil iron core 42 is magnetized, and at that time, the seal member (A3) is separated from the upper surface of the orbiting scroll 5 and a gap (t) is generated. In addition, the compression gas is leaked appropriately through the gap, and the pressure in the compression space (P) is controlled to be desired level. That is, the low capacity is outputted through the discharge pipe (DP: referring to FIG. 9).

As described above, according to the present invention, the sealability of the compressor is increased in the normal operation, and thereby the compression efficiency can be improved. Also, in the low capacity operation, the low capacity can be outputted without decelerating the orbiting scroll, and thereby, the leakage of the compression gas can be prevented effectively. In addition, the controller for controlling the orbiting scroll is not required, and thereby, fabrication cost can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A scroll compressor comprising:

a fixed scroll having a fixed scroll wrap and an orbiting scroll having an orbiting scroll wrap, said fixed scroll and said orbiting scroll having a compression space formed therebetween;

a seal member installed on the fixed scroll to be movable between a first sealing position and a second sealing position so as to variably seal the compression space depending on an operating position of the seal member between the first and the second sealing positions;

at least one tip seal recess being provided on an end of the fixed scroll wrap;

a back pressure passage being formed within said fixed scroll wrap, said back pressure passage being in fluid communication with said at least one tip seal recess and an outer circumferential surface of said fixed scroll; and a valve operatively installed in fluid communication with said back pressure passage, said valve being provided to vary the operating position of said seal member between the first and the second sealing positions to control a capacity of said compressor.

2. The apparatus scroll compressor according to claim 1, wherein a tip seal recess is installed on an end of a wrap on the orbiting scroll, and the seal member is installed within the tip seal recess so as to be movable in a vertical up-and-down direction.

3. The scroll compressor according to claim 1, wherein the valve is installed in a position between a gas discharge pipe and a gas suction pipe of said compressor so as to selectively supply high pressure gas to said back pressure passage and said tip seal recess.

4. The scroll compressor according to claim 3, further comprising:

a discharge bypass pipe installed between the changing valve and the discharge pipe, a suction bypass pipe installed between the changing valve and the suction pipe, and a back pressure pipe installed between the changing valve and the back pressure passage.

5. The scroll compressor of according to claim 1, further comprising:

an exhaust pipe installed on the outer circumferential surface of the fixed scroll in fluid communication with said valve and said back pressure passage, wherein said valve is an exhaust pipe opening and closing valve installed on a center part of the exhaust pipe to selectively open or close the exhaust pipe.

6. The scroll compressor according to claim 5, wherein the exhaust pipe opening and closing valve includes a controller.

7. The scroll compressor according to claim 1, wherein the seal member is formed as a single body.

8. An apparatus for changing capacity of a scroll compressor comprising:

a seal member of metal material installed on a fixed scroll to be movable so as to selectively seal a compression space made by the fixed scroll and an orbiting scroll;

a coil iron core installed in the fixed scroll; and an electric power unit connected to the coil iron core so as to move the seal member by magnetizing the coil iron core selectively.

9. A scroll compressor comprising:

a fixed scroll having a fixed scroll wrap and an orbiting scroll having an orbiting scroll wrap, said fixed scroll and said orbiting scroll having a compression space formed therebetween;

a seal member of metal material installed within the fixed scroll to be movable so as to selectively seal the compression space formed by the fixed scroll and the orbiting scroll;

a coil iron core installed in the fixed scroll; and an electric power unit connected to the coil iron core so as to move the seal member by magnetizing the coil iron core selectively.

10. The scroll compressor according to claim 1, wherein said valve is operated automatically by a controller.

11. The scroll compressor according to claim 1, wherein said valve is a three-way valve.

12. An apparatus for varying a capacity of a compressor, said apparatus comprising:

a fixed scroll having a fixed scroll wrap and partially forming a compression space;

a seal member installed on the fixed scroll to be movable between a first sealing position and a second sealing position so as to variably seal the compression space depending on an operating position of the seal member between the first and the second sealing positions;

at least one tip seal recess being providing on an end of the fixed scroll wrap;

a back pressure passage being formed within said fixed scroll wrap, said back pressure passage being in fluid communication with said at least one tip seal recess and an outer circumferential surface of said fixed scroll; and a valve operatively installed in fluid communication with said back pressure passage, said valve being provided to vary the operating position of said seal member between the first and the second sealing positions to control a capacity of said compressor.

13. The apparatus according to claim 12, wherein the seal member is installed within the tip seal recess so as to be movable in a vertical direction.

14. The apparatus according to claim 12, wherein the valve selectively supplies high pressure gas or low pressure gas to said back pressure passage and said tip seal recess.

15. The apparatus according to claim 12, further comprising an exhaust pipe installed on the outer circumferential surface of the fixed scroll in fluid communication with said valve and said back pressure passage, wherein said valve is an exhaust pipe opening and closing valve installed on a center part of the exhaust pipe to selectively open or close the exhaust pipe.

16. The apparatus according to claim 15, wherein the exhaust pipe opening and closing valve includes a controller.

17. The apparatus according to claim 12, wherein said valve is operated automatically by a controller.

18. The apparatus according to claim 12, wherein said valve is a three-way valve.

19. A scroll compressor having the apparatus according to claim 12, said scroll compressor further comprising:

a casing housing said apparatus for changing capacity of the scroll compressor;

an orbiting scroll partially forming said compression space and being provided within said casing;

a rotating shaft operatively connected to said orbiting scroll;

a discharge pipe; and a suction pipe.

* * * * *